US005455985A

United States Patent [19]

Hamline et al.

[11] Patent Number: 5,455,985

[45] Date of Patent: Oct. 10, 1995

[54] STEERABLE SIDE SQUEEGEES

[75] Inventors: Anthony J. Hamline, Monticello; Steven L. Boomgaarden, Rosemount; Gregory J. Engel, Plymouth; Bryan L. Christensen, Dayton, all of Minn.

[73] Assignee: Tennant Company, Minneapolis, Minn.

[21] Appl. No.: 179,230

[22] Filed: Jan. 10, 1994

[51] Int. Cl.[6] ..... A47L 11/283

[52] U.S. Cl. ..... 15/401; 15/98; 15/320; 15/340.4

[58] Field of Search ..... 15/320, 340.1, 15/340.3, 340.4, 401, 98

[56] References Cited

U.S. PATENT DOCUMENTS 3,833,961 9/1974 Fortman et al. ..... 15/320 X
4,037,289 7/1977 Dojan ..... 15/320
4,158,901 6/1979 Wulff et al. ..... 15/320 X
4,173,056 11/1979 Geyer ..... 15/401 X
5,265,300 11/1993 O'Hara et al. ..... 15/98 X

*Primary Examiner*—Christopher K. Moore
*Attorney, Agent, or Firm*—Dorn, McEachran, Jambor & Keating

[57] ABSTRACT

In a floor scrubbing machine, side squeegees for control of water on the floor are mounted with linkages that include vertical pivots so the squeegees can swing from side to side. They are interconnected with a tie rod so they swing in unison. A rear squeegee swings to one side or the other when the machine turns due to friction with the floor. A push-pull cable is connected between the rear squeegee mounting linkage and the linkage of a side squeegee to cause the side squeegees to swing or steer during turns. This positions them to effectively control water on the floor during a turn, and reduces squeegee wear. An alternative to steering them with the rear squeegee is to steer them with a hydraulic cylinder plumbed into the machine's power steering system.

14 Claims, 4 Drawing Sheets

STEERABLE SIDE SQUEEGEES

BACKGROUND

It is known in the art to build machines for cleaning floors and similar surfaces. These are commonly sweepers or scrubbers, and some provide both functions. We are concerned here with a scrubber, or with the scrubbing elements of a combined sweeper-scrubber.

A floor scrubber operates by applying a solution of water and detergent to the floor, scrubbing with one or more brushes to separate soilage from the floor and suspend it in the solution, then removing the soiled solution from the floor with a vacuum squeegee located behind the brushes. The floor is left damp-dry and soon dries completely, which is important for safety reasons because people can slip and fall on a wet floor.

For this same reason it is important that the machine does not leave puddles of water anywhere. This becomes a consideration when the machine turns, because in sharp turns the side component of machine motion causes the water path coming from the brushes to travel sideways and the rear squeegee will not completely cover it. This leaves a puddle or wet streak on the floor.

Side squeegees have been developed to cope with this problem. These commonly have a single rubber lip pressed against the floor, are placed on either side of the brushes and are generally parallel to the straight travel direction of the machine. In length they extend from about the front of the brushes to somewhat behind them, and their rear ends are often curved inward to better direct water to the rear squeegee, especially in turns. They effectively control the water on the floor in straight travel and in turns if the radius of turn is not too short. They have been used on scrubbers having two rear wheels and one or two steerable front wheels and in which the scrub brushes are mounted close to the rear axle line, either in front of it or behind it. Those vehicle configurations subject the brushes and squeegees to only moderate side motion in a turn, and side squeegees control the water adequately if the flow of water to the floor is reduced before going into a turn. There may be some wet streaking if the water flow is not reduced.

A vehicle layout having two front wheels and a single steerable rear wheel which may also be powered has advantages in some cases, particularly for accommodating the sweeping elements of a combination sweeper-scrubber. A single powered steerable wheel can be turned almost 90 degrees, so very sharp turns are possible. However, in such a turn the rear end of the machine swings almost completely sideways, taking with it any components near the rear wheel, which include the scrub brushes and squeegees. Side squeegees mounted as discussed earlier are not able to control the water on the floor during such extreme side motion, even if the flow of water to the floor is reduced. Water will flow outward past the leading end of the trailing side squeegee, leaving an unacceptable puddle or streak of water on the floor. The leading side squeegee will be subject to abnormal wear due to being "rolled under." This may cause it to interfere with the adjacent scrub brush, which will abrade it severely.

One effort to improve the action of side squeegees on a rear steered scrubber is disclosed in U.S. Pat. No. 4,158,901. Its concept is to couple the side squeegees to the vehicle steering system with a cam and cable arrangement such that both side squeegees are held off the floor during straight travel, and one or the other of them is lowered to the floor during a turn, the one on the inside of the turn being the one that is lowered. This would eliminate the abnormal wear on the leading squeegee, but appears to do nothing for water control. There is still a need for effective side squeegees on a rear steered scrubber.

SUMMARY OF THE INVENTION

The present invention is useful on a scrubber or sweeper-scrubber having a steerable rear wheel, which commonly is also powered. It may also improve the performance of a front steered scrubber. A side squeegee is mounted at each side of the scrub brushes, being held by conventional spring loaded horizontally pivoted linkages that press the squeegees against the floor.

According to the invention these linkages also provide separate vertical pivots, one for each side squeegee, about which they can swing sideways, and a tie rod pivotally connected to both squeegees, so if one swings the other will also swing.

The rear squeegee is mounted with pivoted links which allow it to swing sideways, which it does when the machine turns due to friction with the floor. In the preferred embodiment a bell crank associated with one of the rear squeegee links drives a push-pull cable that swings one of the side squeegees about its vertical axis, which through the tie rod swings the other one in such a way that they are steered into an alignment generally in the same direction as the direction of motion of that portion of the machine frame that is in the vicinity of the side squeegees. Water control is complete regardless of how sharply the machine turns, and abnormal wear on the side squeegees is prevented.

DETAILED DESCRIPTION OF THE INVENTION

Figure 1:
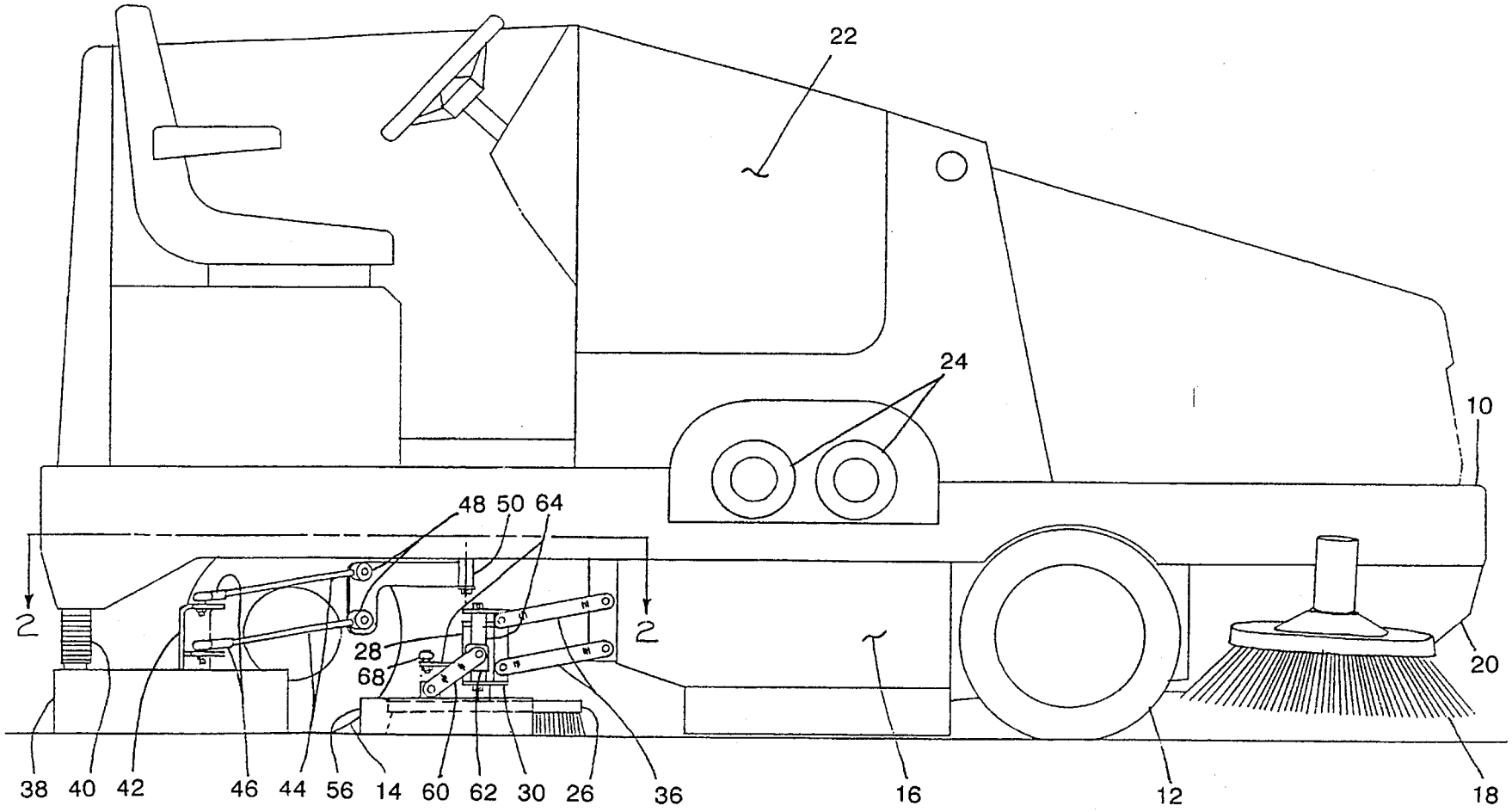
FIG. 1 is a side view of a sweeper-scrubber which uses the present invention.

An industrial sweeper-scrubber which uses the present invention is shown in FIG. 1. It is used for sweeping and/or scrubbing floors in factories, warehouses, and other industrial establishments, as well as for some outdoor work such as cleaning sidewalks and parking lots. As shown in FIG. 1 it has a frame 10, and is supported by two front wheels 12 (only one shown) and one rear wheel 14, which is steerable and powered. The sweeping function is performed by a main sweeping brush (not shown) inside the housing 16 and a side brush or gutter broom 18. Debris swept up from the floor is collected in a debris hopper 20. The present invention is concerned, however, with the scrubber function of this machine, not the sweeper, and since the sweeper design is entirely conventional it will not be discussed further.

The scrubber function operates on the same principle as most scrubbing machines. This is to say that there is a tank which holds a scrubbing solution of water and detergent. This solution is applied to the floor, in this case through the centers of the scrub brushes, which rotate to scrub the floor, loosen the soilage on it and suspend the soilage in the solution. A vacuum squeegee behind the brushes then picks up the soiled solution, which is carried by the vacuum system to a recovery tank for later disposal.

Figure 2:
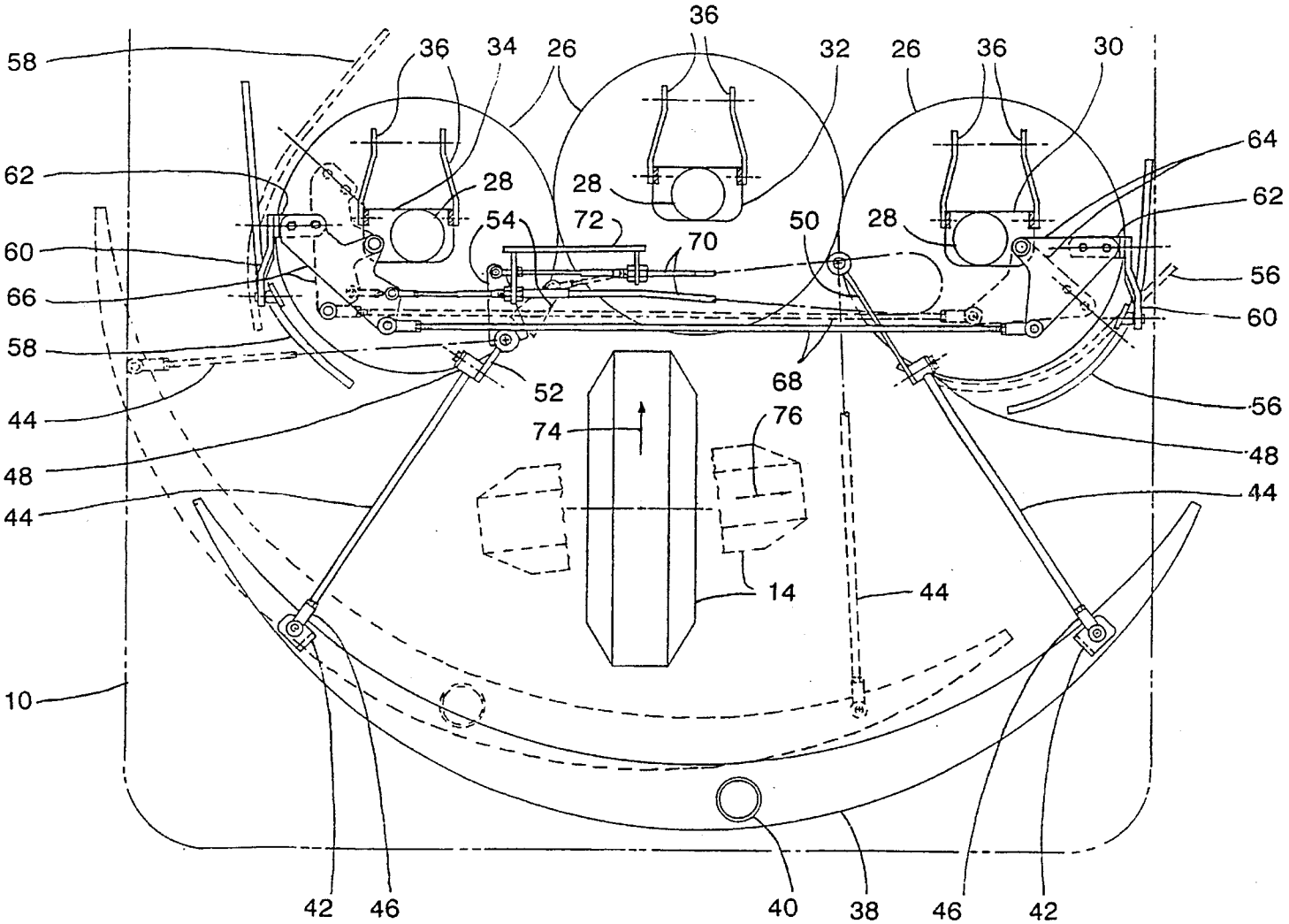
FIG. 2 is a view taken on line 2—2 of FIG. 1 showing the portion of the sweeper-scrubber which contains the invention.

In FIG. 1 the solution and recovery tanks (not shown) are inside the housing 22 and have tank drains 24. As best shown in FIG. 2, there are three circular disc scrub brushes 26 which are attached to and rotated by three hydraulic motors 28. These motors are mounted on right, center and left brackets 30, 32 and 34 respectively, which in turn are attached to a subframe (not shown) of the machine frame 10 in an articulated manner by parallelogram links 36.

A conventional vacuum pickup squeegee 38 is located behind the rear wheel 14 and acts to pick up soiled scrub water from the floor after the brushes 26 have scrubbed it. A vacuum port and flexible hose 40 connect the pickup squeegee 38 in conventional manner to a recovery tank and vacuum blower, neither one shown.

Two brackets 42 are attached to the pickup squeegee 38 to provide attachment points for parallelogram links 44. These links attach squeegee 38 to the machine in an articulated manner which allows the squeegee to move vertically to accommodate variations in the floor and to swing sideways or laterally during turns to better track the water path from the brushes 26. There is considerable friction between pickup squeegee 38 and the floor, and whenever the machine turns from straight line travel this friction provides a force that causes the squeegee to lag behind the sideways travel of the machine. Consequently, relative to the machine frame 10, the rear squeegee 38 swings laterally in a direction toward the inside of the turn, as shown by dotted outline in FIG. 2.

Links 44 are provided with ball joints 46 at their rear ends where they are attached to squeegee brackets 42. At their front ends they have pin joints 48 connecting them to right pivot bracket 50 and left pivot bracket 52. These pin joints allow the pickup squeegee 38 to rise and fall as needed, but when it swings laterally they transmit that motion to the pivot brackets 50 and 52. These brackets are pivotally attached to the frame 10 of the machine and have vertical pivots which accommodate lateral movement of the pickup squeegee. The right pivot bracket 50 has no further function. The left pivot bracket 52 has an arm 54 welded to it which is used in the present invention and will be discussed later.

The reader may have observed that FIG. 2 shows some unsymmetrical construction. Thus the rear wheel 14 is centered laterally in the frame 10, but the three scrub brushes 26 and the pickup squeegee 38 are offset somewhat to the right. This is because the illustrated machine is a sweeper-scrubber. The sweeping path is extended to the right by side brush 18 so the scrubbing elements are offset to the right to cover the path swept by the sweeping elements. This offset is not significant to the invention. Also, the right pivot bracket 50 is farther forward than the left pivot bracket 52. In this particular machine the scrub brushes 26 are attached through links 36 to a subframe (not shown) by which the brushes as a group can be extended laterally to the right by several inches when desired. The unsymmetrical squeegee attachment was done to better cover the scrubbed path in turns whether the brushes were extended or not. This construction also is not significant to the invention. A conventional scrubber can be built that is completely symmetrical and has no lateral extension and the invention can be usefully applied to it with complete success just as it is to the illustrated sweeper-scrubber.

Side squeegees are provided at either side of the scrub brushes 26, the right side squeegee being 56 and the left side squeegee being 58. These are pivotally attached with conventional articulated links 60 which allow them to conform to floor irregularities. Following common practice there are also springs (not shown) that apply down force on the pickup squeegee and the side squeegees to hold them firmly against the floor.

Articulated links 60 and angle brackets 62 connect the right side squeegee 56 to right bellcrank 64 and the left side squeegee 58 to left bellcrank 66. These bellcranks have vertical pivots by which they are pivotally attached to the right motor bracket 30 and the left motor bracket 34 respectively.

Right and left bellcranks 64 and 66 are connected together with tie rod 68 so that the two bellcranks and their attached side squeegees will pivot in unison. The tie rod has ball jointed ends.

As seen in FIG. 2 there is a push-pull cable assembly 70. One end of its sliding inner element is pivotally connected to the arm 54 that is welded to the left pivot bracket 52. The other end is pivotally connected to the left bellcrank 66. The ends of the outer housing of the push-pull cable assembly are anchored to a bracket 72 which is attached to the machine frame 10.

The geometry of the various elements is such that the side squeegees are always aligned generally in the direction that they are moving across the floor. Thus when rear wheel 14 is driving the machine straight ahead as shown by the solid arrow 74, the side squeegees point generally fore and aft, as they are shown in solid lines in FIG. 2. But when rear wheel 14 is turned as shown in dotted lines it will travel to the right as shown by the dotted arrow 76, which will cause the machine to turn to the left about the point 78 which is the intersection of the common axis of the front wheels 12 and the axis of the rear wheel 14. This turning relationship is clearly shown in FIG. 3. The rear squeegee 38, due to friction with the floor, will resist following this new direction of travel and will lag behind as the frame 10 swings to the right in this part of the machine. So, relative to the frame 10, the rear squeegee 38 will swing to the left as shown in dotted outline until it is stopped by a limiting mechanism (not shown).

This movement of the rear squeegee moves arm 54 to its dotted position, which pushes the end of the core of push-pull cable 70 which is pivotally attached to arm 54 into the cable housing. The other end is pushed out, and since it is pivotally attached to left bellcrank 66 it moves that bellcrank and left side squeegee 58 to their dotted positions. Tie rod 68 then pulls right bellcrank 64 and right side squeegee 56 to their dotted positions. The side squeegees will thus be steered to align generally in the direction that they are moving across the floor. Friction between the rear squeegee and the floor supplies more than enough force to steer the side squeegees as described. It will be realized, of course, that while only a turn in one direction is illustrated (rear of machine to the right, machine turning to the left as best shown in FIG. 3), the machine is capable of turning in the opposite direction also, with all the motions that are shown being reversed.

Figure 3:
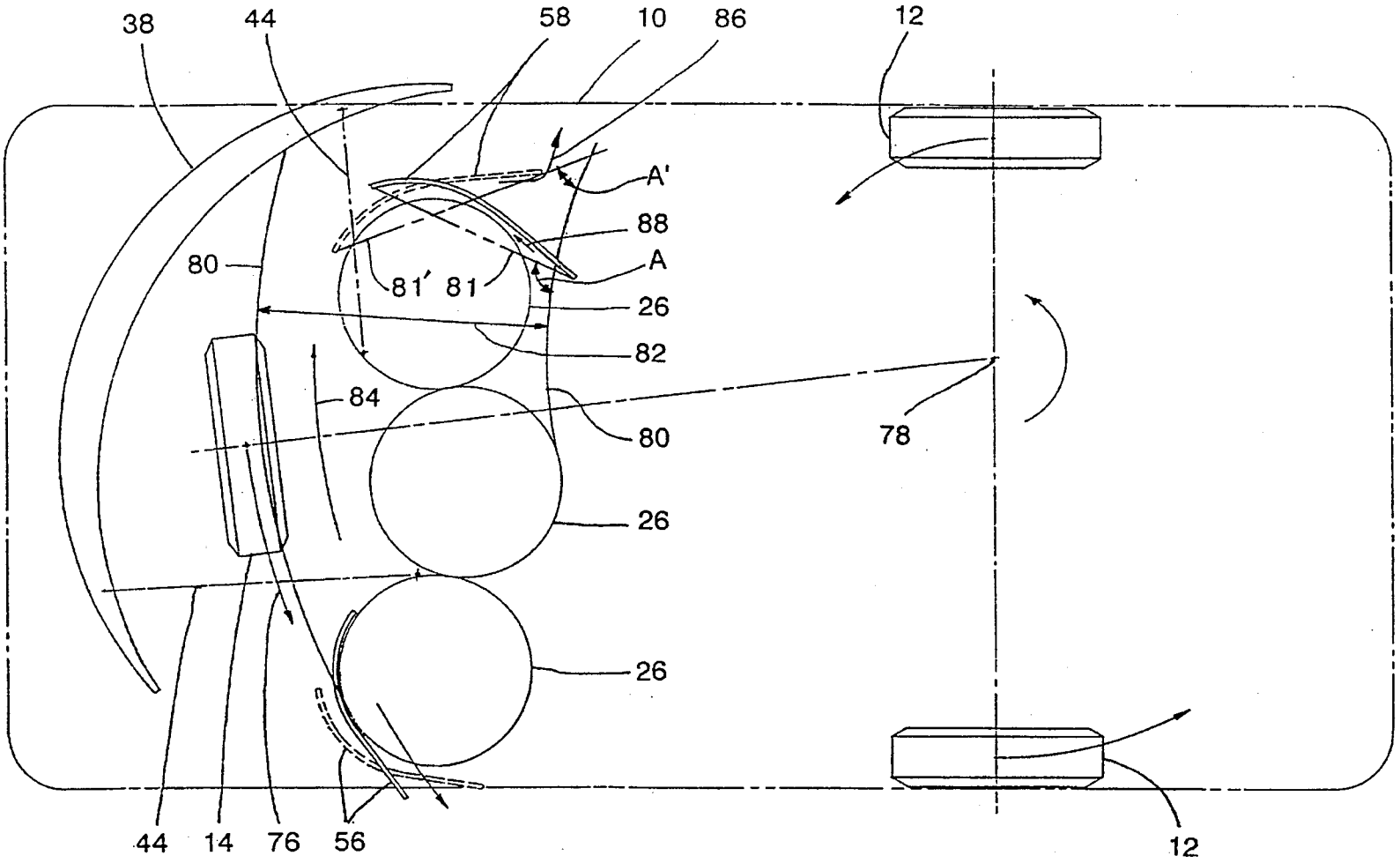
FIG. 3 is a diagram showing the flow path of scrub water on the floor when the scrubber makes a sharp turn and the comparative action of steered and unsteered side squeegees in controlling such flow.

FIG. 3 illustrates how effectively these steered side squeegees work as compared to unsteered side squeegees when the machine makes a sharp turn. The same turn is shown in FIG. 3 as in FIG. 2. The center of the turn is at point 78 at the intersection of the common axis of the two front wheels 12 and the axis of the rear wheel 14. Every point on the machine moves in an arcuate path around this center 78. As described earlier, rear wheel 14 moves to the right in the direction of arrow 76 and rear squeegee 38 swings to the left relative to frame 10 to the position shown in solid lines in FIG. 3 and in dotted lines in FIG. 2. Side squeegees 56 and 58 assume the positions shown in solid lines in FIG. 3, also shown dotted in FIG. 2. Their unsteered or straight ahead positions are shown dotted in FIG. 3, which are the same as their solid line positions in FIG. 2.

Scrub water is fed to the floor through the centers of the brushes 26, which sling it out to their full diameters. During a turn this water lies on the floor, but relative to frame 10 it takes a path in the direction of arrow 84 and would have edges 80 and a width 82 if it weren't restricted by the side squeegees. It will be observed in FIG. 3 that left squeegee 58 in its steered position (solid line) has its front end where it can intercept the forward edge of the water flow so no water can get around the squeegee. If it were not steered it would be in the position shown in dotted lines, and it can be seen that some of the water in the path would escape past the front end of the squeegee.

It should be noted that a line 81 connecting the front and rear ends of steered side squeegee 58 intercepts the water stream during the turn at an angle A of more than 90 degrees. Therefore the water flows toward the rear along the squeegee in the direction of arrow 88. It will flow off of the rear end of side squeegee 58 in the path of rear squeegee 38, which will vacuum it up.

If side squeegee 58 were not steered, but remained in the straight travel position shown in dotted outline in FIG. 3, the line 81' would intercept the water stream at an angle A' of less than 90 degrees. This would cause the water to flow along the squeegee in the direction of dotted arrow 86. It would pass around the front end of the squeegee and be left on the floor because it would be out of the path of the rear squeegee. It thus becomes apparent that steering side squeegee 58 is beneficial for effective water pickup in turns.

In FIG. 3 the right side squeegee 56 is shown in its steered position in solid lines and in its unsteered or straight ahead position in dotted lines. It will be observed that in the unsteered position the leading end of the squeegee would lie at a high angle to its direction of travel during the turn, which would roll the squeegee blade under in a direction opposite to its normal action. That would bring it into interference with the adjacent scrubbing brush, which would wear it out prematurely.

This problem is avoided when right side squeegee 56 is steered during a turn. As shown in solid lines in FIG. 3, the forward end of the steered squeegee aligns parallel to its direction of travel. The curved trailing end of the squeegee is dragged across the floor in its normal manner, which is to say that the squeegee lip flexes away from the adjacent brush just as it normally does in straight travel. This tends to pull the squeegee lip outward along its entire length. It is therefore possible to fit the squeegee very close to the adjacent brush without developing interference.

The squeegees are steered about the pivot centers of bellcranks 64 and 66. In ideal theory these centers would coincide with the centers of the two outboard scrub brushes. This might require a rather expensive construction, however, so locations as shown in FIG. 2 may be chosen as close as practical to the brush centers. This is satisfactory when some adjustment is made in the shapes of the squeegees and the distances that they are set from the brushes.

ALTERNATIVE EMBODIMENTS

The preferred embodiment has been described in which the side squeegees are steered by a push-pull cable coupled between one of the side squeegee bellcranks and a lever arm on the linkage that positions the rear squeegee. In this arrangement the power to steer the side squeegees comes from the frictional force between the rear squeegee and the floor.

Figure 4:
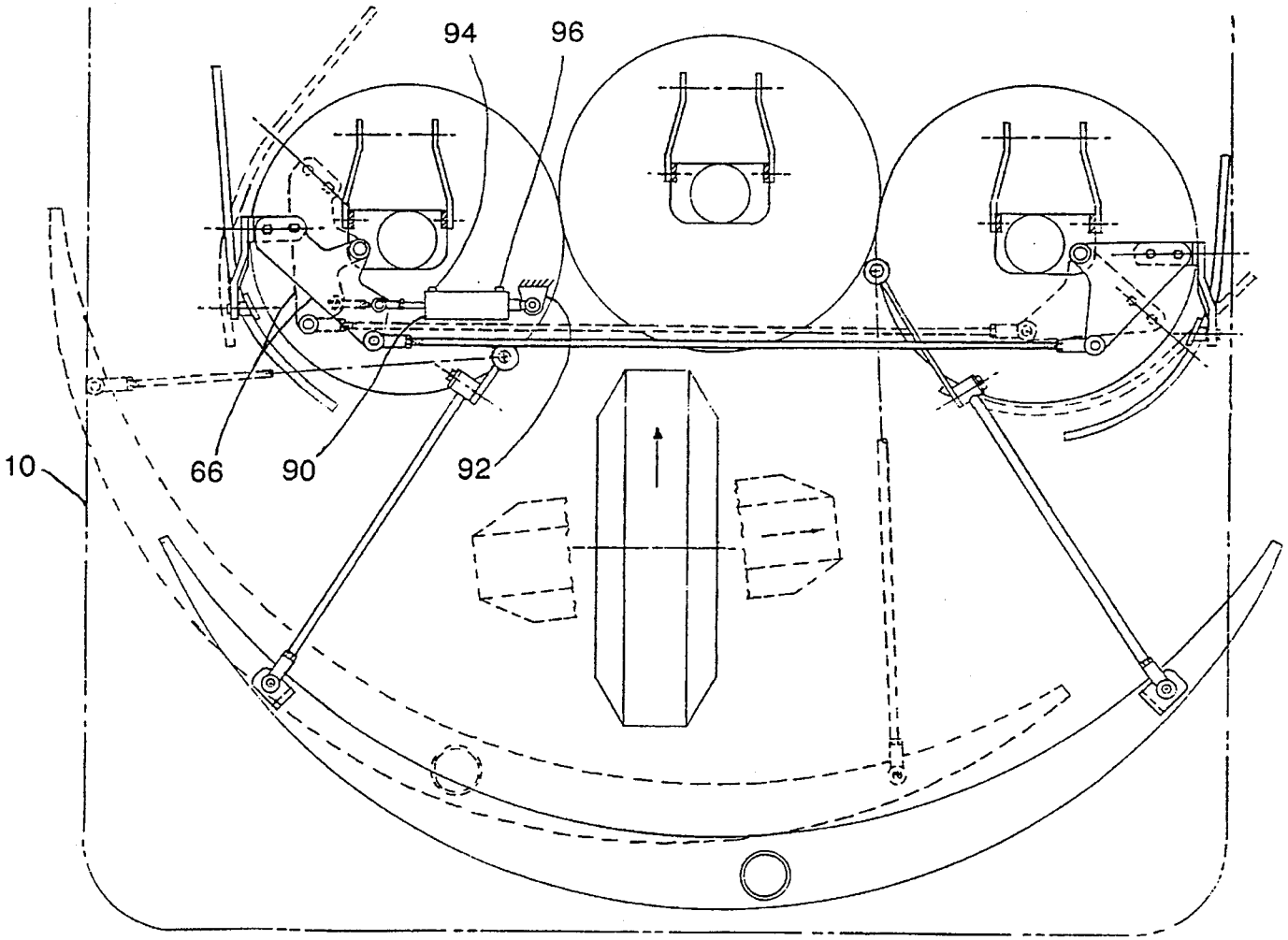
FIG. 4 is a view similar to FIG. 2 which shows an alternative embodiment of the invention.

Another method for steering the side squeegees has been used in which the work is done by a hydraulic cylinder that is fluidly connected into the power steering system of the vehicle. This is illustrated in FIG. 4, in which all the unnumbered parts are unchanged from FIGS. 2 and 3. However, the push-pull cable 70 and its mounting bracket 72 shown in FIG. 2 have been eliminated in FIG. 4. In their place there is a hydraulic cylinder assembly 90, the rod of which is pivotally connected to the left bellcrank 66 at the same point that push-pull cable 70 was connected in FIG. 2. The head end of cylinder 90 is pivotally connected to an anchor bracket 92 which is attached to the machine frame 10. Cylinder 90 has a rod end port 94 and a head end port 96 by which the cylinder is fluidly connected in series with an identical cylinder (not shown) which is the actuator for the vehicle power steering system. In making this series connection the head end port of the vehicle steering cylinder is connected to the head end port 96 of the side squeegee steering cylinder 90. This assures equal volume displacement of hydraulic oil in both cylinders. The rod end port 94 of cylinder 90 is connected into the vehicle power steering system at the point where the rod end port of the vehicle power steering system cylinder would be connected if there were no side squeegee steering cylinder. Apart from the addition of cylinder 90 the vehicle power steering system is entirely conventional and is not a part of this invention.

When two hydraulic cylinders are used in series as done here it is necessary to assure that their strokes will remain synchronized in spite of incidental internal leakage that may occur in time. To do this, cylinder suppliers customarily provide both cylinders with small re-phasing grooves at both ends of their strokes. These by-pass a small amount of oil around the pistons at the ends of the strokes and assure that both pistons bottom solidly against the ends of their cylinders. Thus each time the cylinders are run to full stroke synchronization is re-established that may have been lost due to internal leakage. The cylinders used here are provided with such re-phasing grooves.

This alternative embodiment is known to effectively steer the side squeegees. However, it is a higher cost system than the push-pull cable system. Also, in a sweeper-scrubber the scrub brushes and squeegees are normally raised to a transport position when the sweeper function is being used, and there is no reason to steer the side squeegees at such a time. The push-pull cable system does not operate in transport, since the rear squeegee is off the floor and hence does not develop any frictional force. The hydraulic cylinder system, however, will steer the side squeegees whenever the vehicle is steered, regardless of whether the scrub brushes and squeegees are on the floor or in transport. This forces one or the other of the side squeegees to project out beyond the side of frame 10 during turns, where they risk striking nearby objects, even though the squeegee system may not be in use. It also causes unnecessary wear in the linkage pivots. For these reasons the push-pull cable system is the preferred embodiment.

A person skilled in the art of floor scrubber design will recognize that the invention requires only an interrelationship of one or more scrub brushes, a pair of side squeegees, and either a rear pickup squeegee or a power steering system, and that given these interrelated elements the invention can be made to work regardless of where on the machine these elements are located.

The invention, which comprises steerable side squeegees, has been described as applied to a machine that is driven and steered by a single rear wheel, with scrub brushes located immediately in front of that rear wheel and a pickup squeegee behind it. However, it is common practice to build floor scrubbers with one or two steerable front wheels and two non-steerable rear wheels. Various locations for the scrub brushes are also common; in front of the front wheels, between the front and rear wheels, or behind the rear wheels. The invention can be applied to a floor scrubber having any combination of these variable element locations, so long as it provides the essential elements of one or more scrub brushes, a pair of side squeegees, and either a rear pickup squeegee or a power steering system.

A person skilled in the art would also realize that one could couple two push-pull cables such as 70 to the rear squeegee and run one of them to each of the side squeegees, thereby steering them. This would eliminate the need for tie rod 68. Such a construction would interconnect the side squeegees as effectively as using one cable and a tie rod, and so would lie within the scope of the invention.

We claim:

1. An improved mobile surface cleaning machine comprising a frame to which are attached a steerable wheel with steering means therefore, floor treating members, a vacuum pickup squeegee behind the floor treating members, first and second side squeegees laterally outside of the floor treating members, one on each side of the floor treating members, the improvement characterized by:

(a) mounting the side squeegees so that each of them can pivot about a vertical axis unique to that side squeegee, (b) means interconnecting the two side squeegees whereby if either of them pivots about its vertical axis the other one will also pivot about its vertical axis, and (c) means to apply a lateral force to at least one of said side squeegees when the machine turns from a straight course of travel whereby both side squeegees move about their respective vertical axes and both tend to align generally in the same direction as the direction of movement of that portion of the machine frame in the vicinity of the side squeegees.

2. The surface cleaning machine of claim 1 in which the vacuum pickup squeegee is attached to the frame in a manner that allows it to move laterally relative to the frame and in which frictional force between the vacuum pickup squeegee and the surface being cleaned causes this relative lateral movement to occur when the machine turns from a straight course of travel, characterized by means whereby during said relative lateral movement of the vacuum pickup squeegee at least part of the said frictional force is transmitted to at least one of the side squeegees as the lateral force of claim 1c.

3. The surface cleaning machine of claim 2 having means whereby at least part of the frictional force between the vacuum pickup squeegee and the surface being cleaned is transmitted to at least one of the side squeegees, characterized in that said means comprises a flexible push-pull cable.

4. The surface cleaning machine of claim 1 in which the steering means is a hydraulic power steering system, characterized in that a hydraulic cylinder is mechanically connected to one of the side squeegees, said hydraulic cylinder being fluidly connected to the power steering system such that when the machine is steered from a straight course of travel the said hydraulic cylinder will extend or contract and thereby exert the lateral force of claim 1c.

5. A mobile surface cleaning machine including a frame, a steerable rear wheel mounted to said frame, surface treating members supported on said frame and positioned forward of said steerable rear wheel, said surface treating members, during use, creating a path of soiled liquid, a vacuum pickup squeegee supported on the frame and positioned behind said steerable rear wheel and said surface treating members for removing said soiled liquid from a surface being cleaned, a pair of side squeegees, one on each side of the machine, said side squeegees being positioned laterally outside of the surface treating members and forwardly of the vacuum pickup squeegee, each of said side squeegees being supported for pivotal movement about a vertical axis, means interconnecting said side squeegees for conjoint pivotal movement about their respective axes, means responsive to turning movement of said machine for applying a force to rotate said side squeegees about their respective vertical axes whereby, during turning movement, said vacuum pickup squeegee and the side squeegee on the side of the turning machine toward the center of the turn, in combination, overlap the path of soiled liquid.

6. The mobile surface cleaning machine of claim 5 characterized in that during turning movement, the side squeegee on the side of the turning machine toward the center of the turn is oriented to direct liquid from said path of soiled liquid toward said vacuum pickup squeegee.

7. The mobile surface cleaning machine of claim 5 characterized in that during turning movement the side squeegee on the side of the turning machine away from the center of the turn pivots so that a forward portion thereof is generally in alignment with the direction of movement of that portion of the machine frame which is in the vicinity of said side squeegee.

8. The mobile surface cleaning machine of claim 5 characterized in that said vacuum pickup squeegee is mounted for pivotal movement on said frame, an interconnection between said pivotal vacuum pickup squeegee and said pivotal side squeegees, frictional force developed between said vacuum pickup squeegee and the surface being cleaned during turning movement of the machine applying the force to rotate said side squeegees about their respective vertical axes.

9. The mobile surface cleaning machine of claim 8 characterized in that said interconnection includes a tie rod pivotally connecting said side squeegees, and a flexible connection between one of said side squeegees and said pivotal vacuum pickup squeegee.

10. The mobile surface cleaning machine of claim 5 characterized in that said steerable rear wheel is steered by hydraulic means, and a hydraulic piston and cylinder assembly in hydraulic circuit with said hydraulic means for steering said steerable rear wheel, said hydraulic piston and cylinder assembly applying a rotating force to said side squeegees conjointly with the steering of said steerable rear wheel.

11. The mobile surface cleaning machine of claim 10 characterized by and including a tie rod interconnecting said pivotal side squeegees, said piston and cylinder assembly being connected to one of said pivotal side squeegees.

12. A mobile surface cleaning machine including a frame, a steerable wheel mounted to said frame, surface treating members supported on said frame, said surface treating members, during use, creating a path of soiled liquid, a vacuum pickup squeegee supported on the frame and positioned behind said surface treating members for removing said soiled liquid from a surface, a pair of side squeegees, one on each side of the machine, said side squeegees being positioned laterally outside of the surface treating members and forwardly of the vacuum pickup squeegee, each of said side squeegees being supported for pivotal movement about a vertical axis, said vacuum pickup squeegee being mounted for pivotal movement on said frame, an interconnection between said vacuum pickup squeegee and said side squeegees, frictional force developed between said vacuum pickup squeegee and the surface being cleaned during turning movement of the machine applying a force during a turn to rotate the side squeegee on the side of the machine toward the center of the turn so that the vacuum pickup squeegee and said side squeegee toward the center of the turn, in combination, overlap the path of soiled liquid.

13. The mobile surface cleaning machine of claim 12 characterized by means interconnecting said side squeegees for conjoint pivotal movement about their respective axes.

14. The mobile surface cleaning machine of claim 12 characterized in that said steerable wheel is mounted rearwardly of said surface treating members.

* * * * *